US006947564B1

(12) United States Patent
Hoover

(10) Patent No.: US 6,947,564 B1
(45) Date of Patent: Sep. 20, 2005

(54) STEREOPHONIC SPATIAL EXPANSION CIRCUIT WITH TONAL COMPENSATION AND ACTIVE MATRIXING

(75) Inventor: Alan Anderson Hoover, Indianapolis, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 09/869,493

(22) PCT Filed: Dec. 15, 1999

(86) PCT No.: PCT/US99/29938

§ 371 (c)(1),
(2), (4) Date: Jun. 28, 2001

(87) PCT Pub. No.: WO00/42818

PCT Pub. Date: Jul. 20, 2000

Related U.S. Application Data

(60) Provisional application No. 60/115,324, filed on Jan. 11, 1999.

(51) Int. Cl.[7] ..... H04R 5/00
(52) U.S. Cl. ..... 381/1; 381/2; 381/17
(58) Field of Search ..... 381/1, 2, 17, 18, 381/19, 20, 21, 22, 23

(56) References Cited

U.S. PATENT DOCUMENTS

| | | | | |
|---|---|---|---|---|
| 4,063,034 A | | 12/1977 | Peters | 179/1 |
| 4,495,637 A | | 1/1985 | Bruney | 381/1 |
| 4,696,035 A | | 9/1987 | Torelli et al. | 381/1 |
| 4,748,669 A | | 5/1988 | Klayman | 381/1 |
| 4,831,652 A | | 5/1989 | Anderson et al. | 381/1 |
| 4,866,774 A | | 9/1989 | Klayman | 381/1 |
| 5,208,493 A | | 5/1993 | Lendaro et al. | 307/529 |
| 5,319,713 A | | 6/1994 | Waller, Jr. et al. | 381/22 |
| 5,400,405 A | | 3/1995 | Petroff | 381/1 |
| 5,661,808 A | | 8/1997 | Klayman | 381/1 |
| 5,692,050 A | * | 11/1997 | Hawks | 381/1 |
| 5,774,556 A | | 6/1998 | Lowe et al. | 381/17 |
| 5,796,844 A | | 8/1998 | Griesinger | 381/18 |
| 5,838,800 A | | 11/1998 | Lowe et al. | 381/17 |
| 5,850,453 A | | 12/1998 | Klayman et al. | 381/1 |
| 5,872,851 A | | 2/1999 | Petroff | 381/18 |
| 5,883,962 A | | 3/1999 | Hawks | 381/1 |
| 5,892,830 A | | 4/1999 | Klayman | 381/1 |
| 5,892,831 A | * | 4/1999 | Schott | 381/1 |
| 5,930,733 A | | 7/1999 | Park et al. | 702/76 |

FOREIGN PATENT DOCUMENTS

| | | | |
|---|---|---|---|
| EP | 0865226 | 9/1998 | H04S 1/00 |
| WO | 98/36614 | 8/1998 | H04S 1/00 |

* cited by examiner

*Primary Examiner*—Sinh Tran
*Assistant Examiner*—Justin Michalski
(74) *Attorney, Agent, or Firm*—Joseph S. Tripoli; Joseph J. Laks; Reitseng Lin

(57) ABSTRACT

In a stereophonic expansion circuit, the (L+R) sum signal is spectrally modified by increasing the bass and treble frequencies relative to the midrange so as to compensate for a midrange frequency boost in the (L−R) difference signal. The stereophonic expansion effect and manipulation of the signal parameters are produced by active matrixing amplifiers.

10 Claims, 5 Drawing Sheets

STEREOPHONIC SPATIAL EXPANSION CIRCUIT WITH TONAL COMPENSATION AND ACTIVE MATRIXING

CLAIM OF PRIORITY

A right of priority is claimed from U.S. provisional patent application No. 60/115,324, filed Jan. 11, 1999 which is hereby incorporated herein by reference, and which claims the benefit under 35 U.S.C. § 365 of International Application PCT/US99/29938, filed Dec. 15, 1999, which was published in accordance with PCT Article 21(2) on Jul. 20, 2000 in English.

FIELD OF THE INVENTION

The present invention relates to a television receiver for receiving television program signals which include stereophonic sound signals, and, more particularly, to the generation of a psychoacoustic stereophonic expansion effect so that it acoustically appears to the listener that the spatial separation of the loudspeakers is greater than the actual physical separation.

BACKGROUND

Stereo expansion in audio systems is well known in the art and has been available for many years. In such systems, the right and left channel signals are processed in a manner wherein psychoacoustic effects makes it acoustically appear to the listener that the spatial separation of the loudspeakers is greater than the actual physical separation. Stereo expansion is described in, % inter alia, U.S. Pat. Nos. 4,495,637 of Bruney, 4,831,652 of Anderson et al., 5,208,493 of Lendaro et al., and 5,850,453 of Klayman et al., and e.g., was used in the RCA CTC 169 color television chassis of Thomson Consumer Electronics Inc., U.S.A.

An exemplary prior art stereo expansion circuit is shown in FIG. 1. wherein stereo expansion circuit 10 includes two operational amplifiers (opamps) 11 and 12. A left (L) channel signal is applied to the positive (non-inverting) input terminal of opamp 11 by way of an input line 13. A portion of the right (R) stereo channel is cross-fed to the left (L) channel opamp 11 at the inverting input terminal thereof. A similarly processed inverted portion of the left channel is cross-fed to the right channel opamp 12 at the inverting input terminal thereof.

Again referring to FIG. 1, the right and left channel signals are fed back by the respective resistors 16 and 19. The cross-channel cross-fed signals cause each channel's output to effect the output of the other channel. Specifically, because of the cross-feeding, the output signal on the left output line 15 of the opamp 11 is a L+X(L−R) signal while the output signal on the right output line 18 of the opamp 12 is a R+X(R−L) signal with the coefficient "X" being determined by the characteristics of the filter 22, and typically is between the values of one and two.

Filter 22 of the cross-feeding circuit includes a capacitor 24 and a resistor 25 which determine the crossover frequency at which cross-feeding occurs, i.e., very little coupling between channels at low frequencies, increased coupling as the frequency increases from about 150 Hz or 200 Hz, and full coupling at about 1 KHz to 3 KHz. The parallel combinations of resistor 16 and capacitor 27L, and resistor 19 and capacitor 27R, roll-off the frequency response of amplifiers 11 and 12 respectively to decrease the coupling between the channels through transmission gate 21 to virtually zero above 5 KHz, For the circuit of FIG. 1, the upper frequency break point for an exemplary channel is Fu=1/(2πcapacitor 27)(resistor 19)) and the lower frequency break point is Fl= 1/(2π(capacitor 24)(resistor 25)). The frequency vs. amplitude response of the prior art circuit of FIG. 1 for a single channel input signal is shown in FIG. 2.

The bandlimiting of the crossfed signal to the midrange frequencies for the circuit shown in FIG. 1 often causes two undesirable artifacts of the perceived sound:

1. The overall sound tonality seems to have an increased midrange boost (FIG. 2) while the perceived center-stage image and tonality remain unchanged. Thus, the new perceived sound source, apparently located physically outside the stereo speaker pair locations, has a distinct midrange quality which appears in addition to the existing perceived image near center stage. If the listener moves to an off-axis location where the perceived stereo image deteriorates, the adding of the "expanded stereo" is heard as a midrange increase.
2. The midrange expanded-image program material can "drown out" a center stage performer particularly when the program material has a high content of difference signal (L−R) relative to sum signal (L+R) material.

SUMMARY OF THE INVENTION

The present invention is intended to solve the problem of the undesirable artifacts discussed above in the perceived sound that often occur as a result of the "expanded stereo" function while still preserving the perception of an expanded stereo image.

In order that low frequency program material (bass) not be reduced in amplitude, the (L−R) gain increase is usually confined to the midrange portion of the audio spectrum. The reason for this is that bass program material is often mixed monaurally so that both loudspeakers will share the duty equally in reproducing bass, which requires the most acoustic power to be produced by the power amplifiers and the loudspeakers. This does not detract from the psychoacoustic phenomenon of stereo imaging, because most imaging comes from phase and amplitude differences in the mid-frequency range of audio that reaches the ears from both loudspeakers. This phenomenon has been widely studied and has been documented in many publications.

The present invention spectrally modifies the stereo sum signal by increasing the bass and treble frequencies of the signal relative to the midrange. The spectral modification is approximately complementary to the midrange frequency boost of the difference signal, which is used to produce the expanded stereo effect so as to provide a flatter frequency response to the total signal.

The subjective impression that is created as a result of these modifications are:

1. The addition of bass and treble boost to the (L+R) signal restores tonal balance to the overall signal that is lost when the (L−R) signal is boosted in the mid-frequency range.
2. The addition of treble to the (L+R) signal adds intelligibility to center-stage vocalists by making spoken sounds louder. The "drowned-out" center-stage vocalist problem is eliminated or reduced.

For a stereo image expansion circuit, the amount of expansion that is perceived is proportional to the amount of the midrange difference signal relative to the sum signal. This could be the amount of (L−R) midrange signal that is boosted relative to the (L+R) signal. There is no "exact" amount of difference signal midrange boost relative to sum signal that is "correct" and it is largely a matter of listener preference. The exact frequency band that is boosted is also not of critical importance, although if the midrange frequency is allowed to become too low in frequency, bass loss will be noticed, if the midrange frequency is allowed to become too high in frequency, an unstable image that appears to wander will be noticed, and if the crossfed frequency band is too narrow, the expansion will not seem realistic due to excessive tonal difference between the expanded and center portions of the stereo image.

The (L+R) and (L−R) signals can be derived from stereo detection of a stereophonic broadcast, or from left and right signals which are provided by a signal source, e.g., phonograph record, tape, CD or DVD disk, which are active matrixed to provide (L+R) and (L−R) signals in order to provide the spatial expansion effect. As used herein, active matrixing means active amplifiers having predetermined gain, which are coupled in a matrixing configuration.

DESCRIPTION OF THE PREFERRED EMBODIMENT(S)

Figure 3:
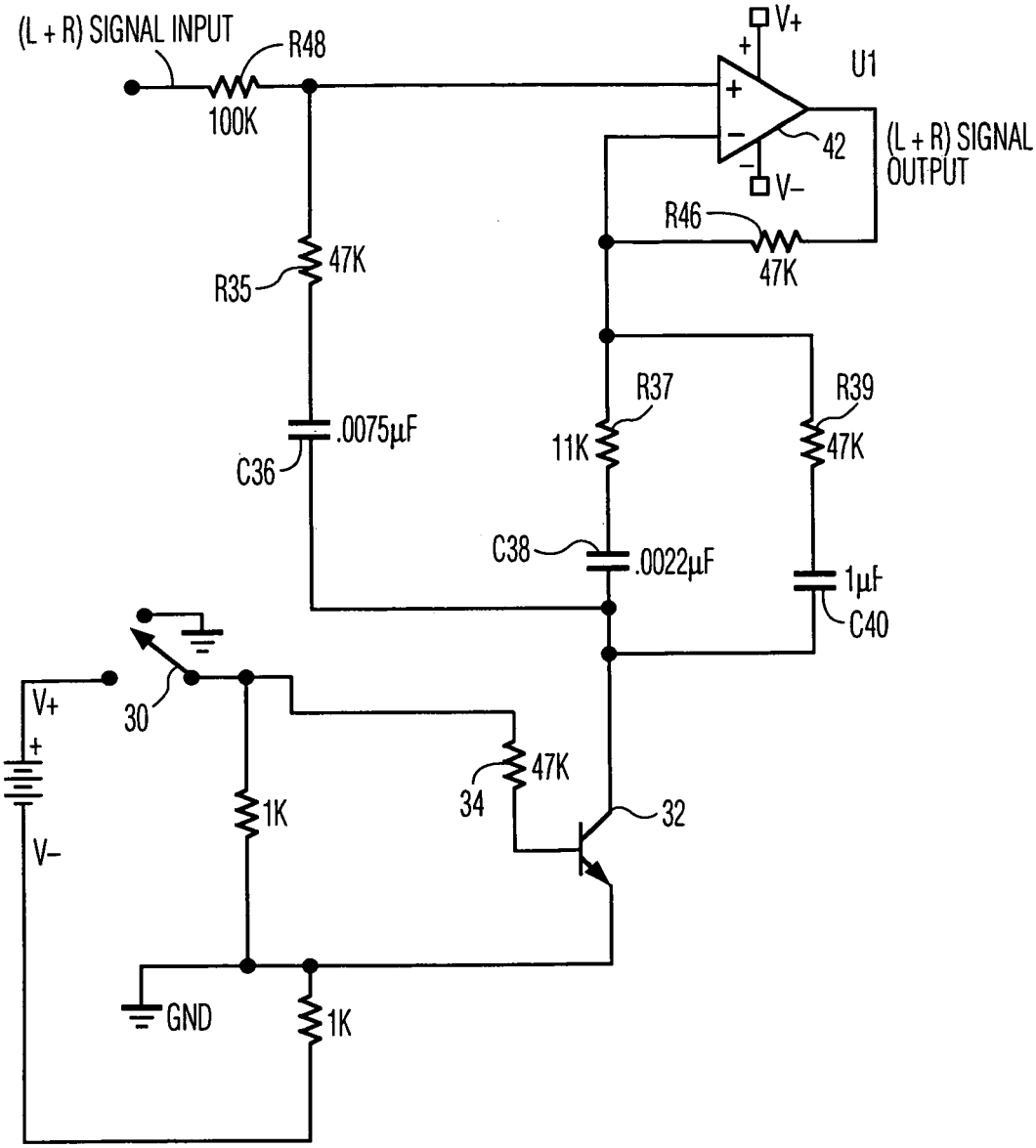
FIG. 3 is a schematic diagram of an (L+R) circuit with tonal compensation according to aspects of the present invention.

FIG. 3 shows the (L+R) signal path modified according to aspects of the present invention to restore tonal balance to the expansion function. This circuit includes a switch for switching the tonal compensation "in" and "out" by the application or the stopping of base current to transistor 32 through resistor 34. By connecting the terminal of 34 to a dc supply of approximately 5 to 15 volts, transistor 32 is turned "on" (saturated). This grounds the ground terminals of 36, 38, and 40 which are all connected to the collector electrode of transistor 32. In this mode, the circuit has the frequency response shown in FIG. 4. If the base resistor 34 is grounded, then transistor 32 is turned "off" and amplifier 42 is effectively a unity gain follower with a flat frequency response. Normally, the placement of transistor 32 into saturation would be accomplished by a control signal actuated by the end user, and would be implemented under microprocessor control (not shown) of the television signal receiver, sound system, or the like.

Taking the time constants of FIG. 3 in order from lowest frequency to highest frequency, and taking transistor 32 as being in saturation; as follows:

The RC time constant which takes effect at the lowest frequency is resistor 39/capacitor 40 (47 K, 1 uF, respectively). Amplifier 42 is effectively a unity gain inverter from 0 Hz to about 3.4 Hz, where the resistance value of resistor 39 equals the impedance of capacitor 40. Above 3.4 Hz, the voltage gain of amplifier 42 approaches two, which is determined by resistors (46+39)/39. For audible frequencies, the gain of amplifier 42 can be considered to be 2 or higher.

Resistors (35+48)/capacitor 36 (47 K, 100K, 0.0075 uF, respectively) form a lowpass filter having a first breakpoint of 3 dB down at 144 Hz. As the signal frequency increases, the voltage divider formed by resistors 48 and 46 determines the final signal gain of amplifier 42. The final attenuation is resistor 35/(resistors 35+48), or −9 dB. Thus, from the subaudible frequency of 3.4 Hz, the overall system gain is about 6 dB, until the resistors (35+48)/capacitor 36 lowpass filter starts to reduce the overall system gain in the 100 to 200 Hz range.

At a frequency of about 2 KHz, the reactance of capacitor 38 (0.0022 uF) plus resistor 37 equals the resistance of resistor 39. At this frequency, the voltage gain of amplifier 42 starts to increase above two because the series network impedance of resistor 37 and capacitor 38 starts to dominate the impedance between the negative input terminal of amplifier 42 and ground. This gain increase offsets the attenuation of divider resistor 35/resistors (48+35). At a frequency of about 6.6 KHz, the reactance of capacitor 38 equals resistor 37 and the gain of amplifier 42 starts to level off, approaching a final value of about +6 dB.

Figure 4:
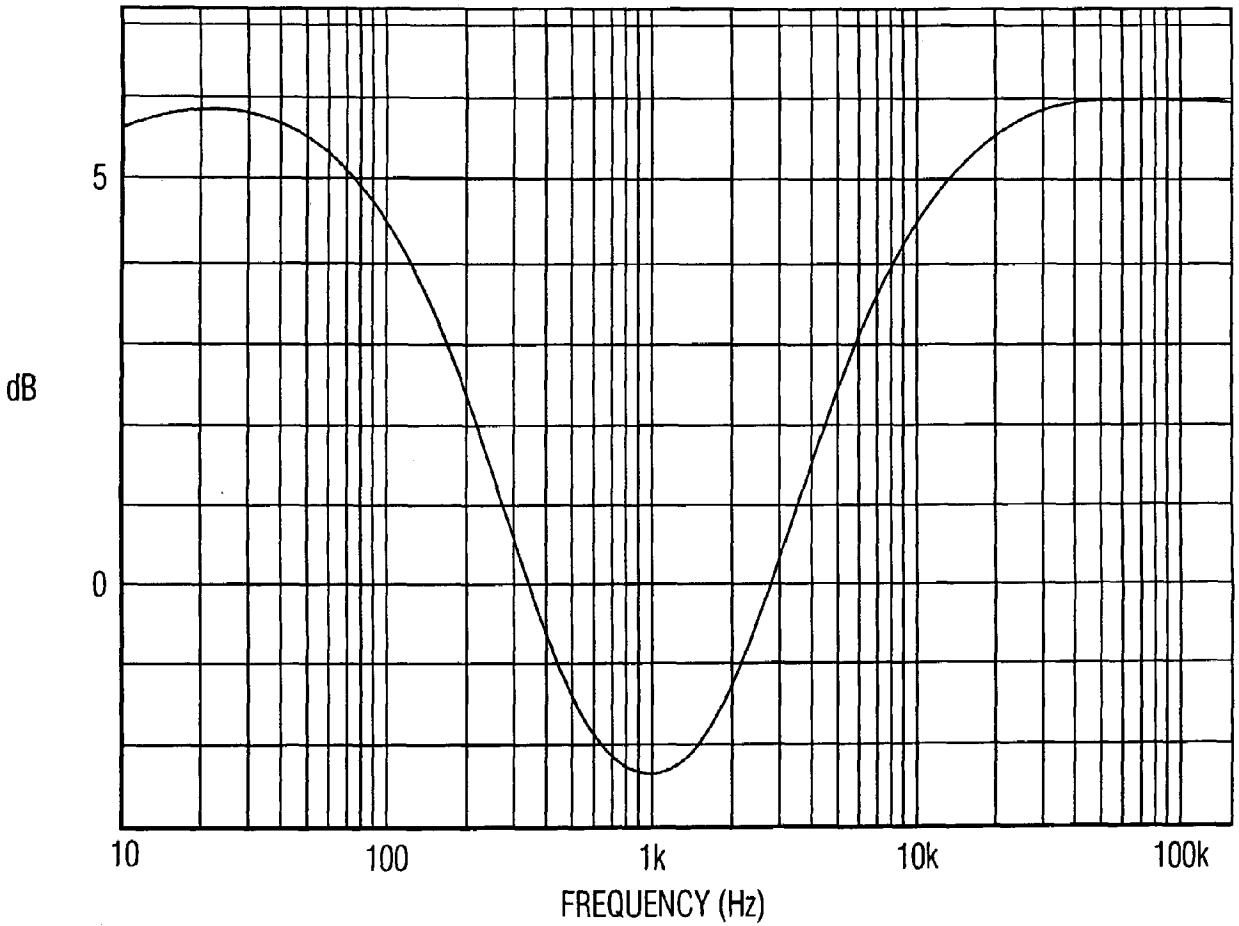
FIG. 4 is a graph of frequency vs. amplitude for the circuit of FIG. 3.

FIG. 4 is a graph showing the gain vs frequency characteristics of the circuit of FIG. 3, as discussed above.

FIG. 5

Figure 5:
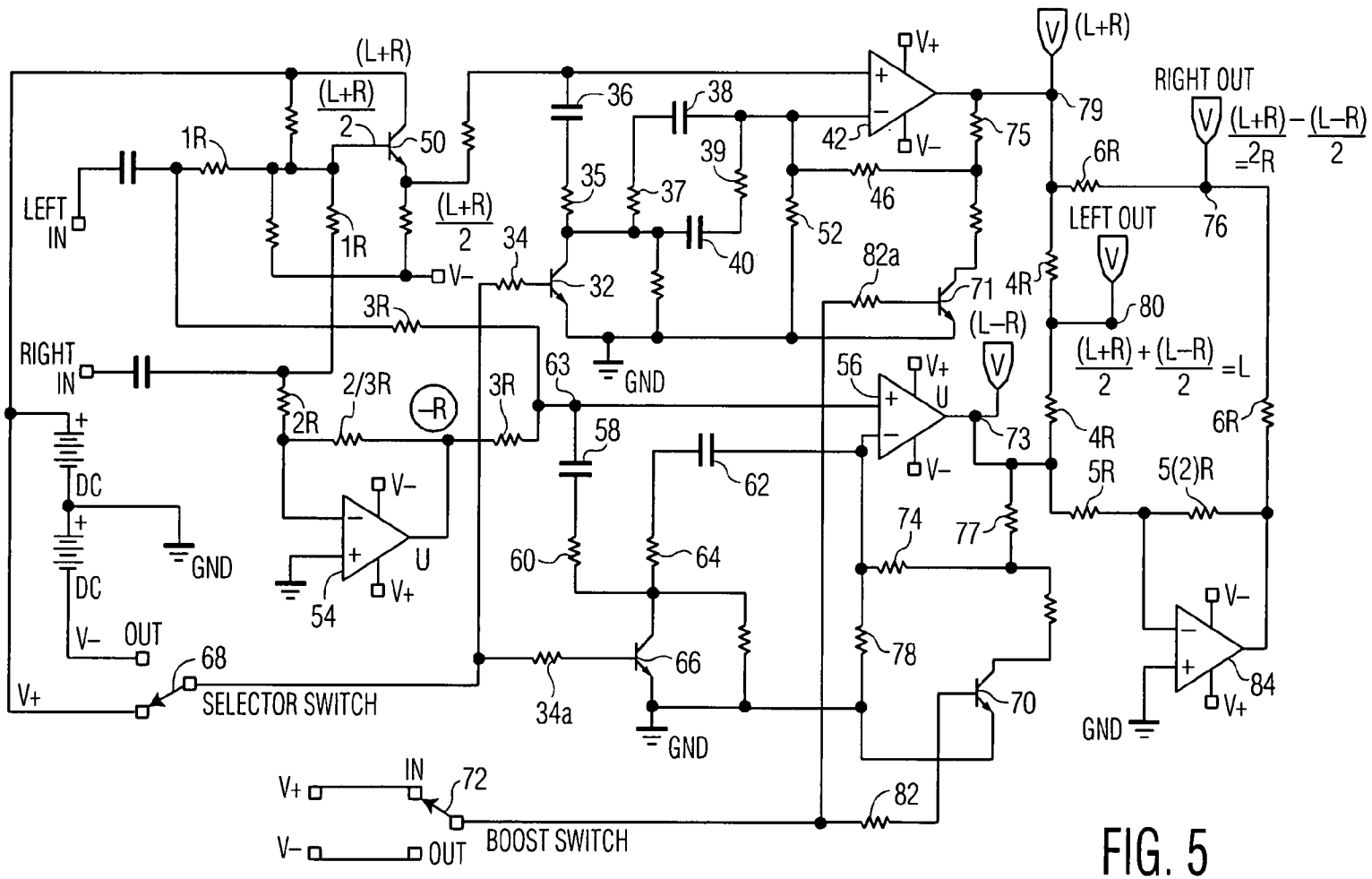
FIG. 5 is a schematic diagram of a stereophonic expansion circuit according to aspects of the present invention, using active matrixing, providing the stereophonic expansion effect and including tonal compensation.

The tonal compensation circuit of FIG. 3 for the (L+R) signal is included in the spatial stereophonic expansion circuit shown in FIG. 5 wherein the stereophonic expansion is accomplished by processing the (L+R) and (L−R) signals. After spatial stereophonic expansion, the L and R signals with tonal compensation are derived from the modified (L+R) and (L−R) signals by active matrixing.

Reference will now be made to FIG. 5, wherein the present invention achieves stereo image expansion, sum signal tonal restoration, and active amplifier signal matrixing, as follows:

Generally, as an overview, if the signal is derived from a source which provides left and right signals, difference and sum circuits are utilized to combine the left and right stereo channel signals into difference (L−R) and sum (L+R) signals by active amplifier matrixing. Filter and gain circuits are used to tonally compensate the (L+R) signal so that it is boosted in the bass and treble frequencies, as discussed above in connection with FIG. 3 and shown in FIG. 4. Filter and gain circuits are used to modify the (L−R) signal so that it is boosted in the midrange frequencies and provides the spatial expansion effect. The modified (L−R) and (L+R) signals are then matrixed back into modified left and modified right signals, using difference and sum active amplifier matrixing. The tonally compensated (L+R), (L−R), R and L signals are available for further processing, as desired.

For the purposes of the discussion below:

1) Bias resistors and coupling capacitors are not discussed or numerically designated but are only shown for completeness.
2) Where the values of resistors are used for matrixing, the designation XR is used to indicate the equal values between that resistor R and a corresponding matrixing resistor R having the same numeral designation. Thus, the numeral designator is used to distinguish between different R resistor sets which can have greatly differing values.
3) Where the components have been discussed above in connection with FIG. 3, identical numeral designations are used.

4) No differentiation is made as to whether the signals at the nodes have been modified as to tonality. The nodal designations of signals are intended to demonstrate the matrixing function. Thus, e.g., if a signal at a node is shown as divided by two, the halving is accomplished by the matrixing function as determined by the matrixing resistors and matrixing amplifiers.

(L+R) Signal Path

Left and Right stereophonic inputs are summed through equal resistors symbolically designated 1R, forming an (L+R) sum signal at the base of emitter follower transistor 50 having approximately unity gain. The values of bias resistors have sufficiently high values so as not to significantly load the (L+R) sum signal. The (L+R) signal is applied to the non-inverting input of opamp 42.

Passive resistors 35, 37, 39, and capacitors 36, 38, 40 alter the spectral response of the buffered (L+R) signal, as discussed above in connection with FIG. 3 and shown in FIG. 4. When transistor 32 is placed in a non-conducting state, passive components resistors 35, 37, 39, and capacitors 36, 38, 40 have no effect on the buffered (L+R) signal and opamp 42 functions as a non-inverting amplifier with a gain set by resistors (46+52)/52, or approximately 2:1. The transistor 32 is an example of a first switch, and the resistors 46 and 52 are examples of first and fourth impedance networks, respectively. The network formed by the resistors 37, 39, and capacitors 38, 40 is an example of a second impedance network. The network formed by the resistor 35 and the capacitor 36 is an example of a third impedance network.

(L−R) Signal Path

The right channel input is coupled through resistors 2R to an inverting input of opamp 54 to become −R at the output. Lin and −Rin are summed by respective further resistors 3R to form the (L−R) signal at node 63 and noninverting input of opamp 56. Opamp 56 is a noninverting gain amplifier when an expansion function, which will be discussed herein below, is "off" because resistors 60, 64 and capacitors 58, 62 are effectively out of the circuit when transistor 66 is cut-off with its base connected to −V by selector switch 68 through resistor 34*a*. The same discussion above in connection with switch 68 and transistor 32 are applicable hereat when transistor 66 goes into saturation and components 58, 60, 62 and 64 come into play. The transistor 66 is an example of a third switch, the network formed by the resistor 64 and the capacitor 62 is an example of a sixth impedance network, and the network formed by the capacitor 58 and the resistor 60 is an example of the seventh impedance network.

For the following discussion, boost transistor 70 is assumed to be in the off state, with boost switch 72 connected to an appropriate negative voltage by being placed in the "out" position. Transistors 32 and 66 are placed into a saturated state by placing switch 68 to the "in" position. Since the collector of transistor 66 is effectively grounded in this condition, the node which connects the collector of transistor 66 is effectively grounded. The transistor 70 is an example of a fourth switch, and resistor 78 is an example of an eighth impedance network.

Transistors 70 and 71 provide an expansion "boost", when transistors 70, 71 are placed into saturation by boost switch 72 via base resistors 82, 82*a*, an additional gain boost is placed in the feedback loop of opamps 56, 42 by placing respective resistors 77, 75 in series with resistors 74, 46, with both in parallel with respective resistors 78, 52. The boost of the (L+R) signal and the (L−R) signal may or may not be the same. Thus, this can provide a few more dB of gain to the (L−R) signal path with respect to the (L+R) signal path for providing the desired amount of expansion effect. The transistor 71 is an example of a second switch, and the resistor 74 is an example of a fifth impedance network.

It should be noted that switching transistors 32, 66, 70 and 71 can be field effect transistors, mechanical switches, or the like.

Feedback resistors 77 and 74 have preferred values of 1 K and 100 K, respectively. At very low audio frequencies, the gain of opamp 56 is set by resistors 77 and 74 in series, and resistor 78, because the reactance of capacitor 62 is very high. The gain is approximately two (6 dB) at low audio frequencies, A similar operation applies to opamp 42 in connection with resistors 75, 46, capacitor 38, and transistor 71.

The reactance of capacitor 62 (preferably 0.056 uF) is 100 K ohms at a frequency of approximately 28 Hz. At this breakpoint frequency, the reactance of capacitor 62 equals the sum of resistors 77 and 74. The gain of opamp 56 starts to rise. The opamp 56 gain rises until the reactance of capacitor 62 equals the resistance of resistor 64 (24 K). The gain of opamp 56 is now the impedance of capacitor 62 plus resistor 64, in parallel with resistor 78 plus resistors 74+77 divided by the previous quantity. At the frequency of 120 Hz, the gain stops rising and levels off at a gain of about 16 dB minus the input attenuation of 6 dB.

As the audio frequency becomes higher, the reactance of capacitor 58 starts to change and come into importance. The frequency where impedance of capacitor 58 equals the parallel combination of the set of 3R resistors at node 63 coupling signal to resistor 60, is approximately 2.9 KHz. This is the frequency at which a high frequency rolloff occurs. After another decade of frequency rise, the reactance of capacitor 58 is low and the curve flattens out to zero dB.

Combining/Matrixing the (L−R) and (L+R) Signals

The (L−R) signal path provides the expansion function that is heard by the listener. The rising midrange of (L−R) provides the out-of-phase frequencies at the left and right ears at the appropriate wavelengths that psychoacoustically produce the directional cues for the perception of the direction from which the sound originates. According to aspects of the present invention, the (L+R) frequency response provides a compensating frequency response, which may or may not be complimentary to the frequency response of the (L−R) signal path and tends to make the overall frequency response flatter when summed with the signal of the (L−R) channel.

The (L−R) signal at node 73 is added to the (L+R) signal at node 79 through respective resistors 4R for producing the L signal at node 80. The (L−R) signal at node 73 is amplified by opamp 84 which according to the 5(2)R (a value of 2 times R) feedback resistor to resistor 5R provides an amplification of two, which when added through its resistor 6R to (L+R) through resistor 6R provides the R signal at node 76.

Stereo expansion is provided by making the difference signal larger than the sum signal. The amount of larger (L−R) signal is determined by listening because it involves a psychoacoustic interpretation by the brain of what both ears are hearing. If an A/B comparison is done, most people will start hearing expansion as soon as the (L−R) is boosted one or two dB relative to the (L+R) signal.

Stereo image expansion appears to work better if the difference signal boost is confined to the midrange frequencies. However, this results in the unwanted artifacts discussed earlier. To compensate for such artifacts, according to aspects of the present invention, the compensating frequency response in the (L+R) signal is provided.

Optimization can be accomplished by listening to a variety of program material to determine that: (1) A significant amount of expansion is heard for most stereo program material, both music and movie, and (2) There is no excessive masking of spoken/sung vocals. This usually means that the amount of the expansion (L−R) signal is larger by between 3 and 10 dB. This can be accomplished by increasing the gain of the opamps 56, 84 in the (L−R) signal path. For item (2) above, treble boost of the (L+R) signal restores lost sibilants resulting in greater intelligibility.

Figure 1:
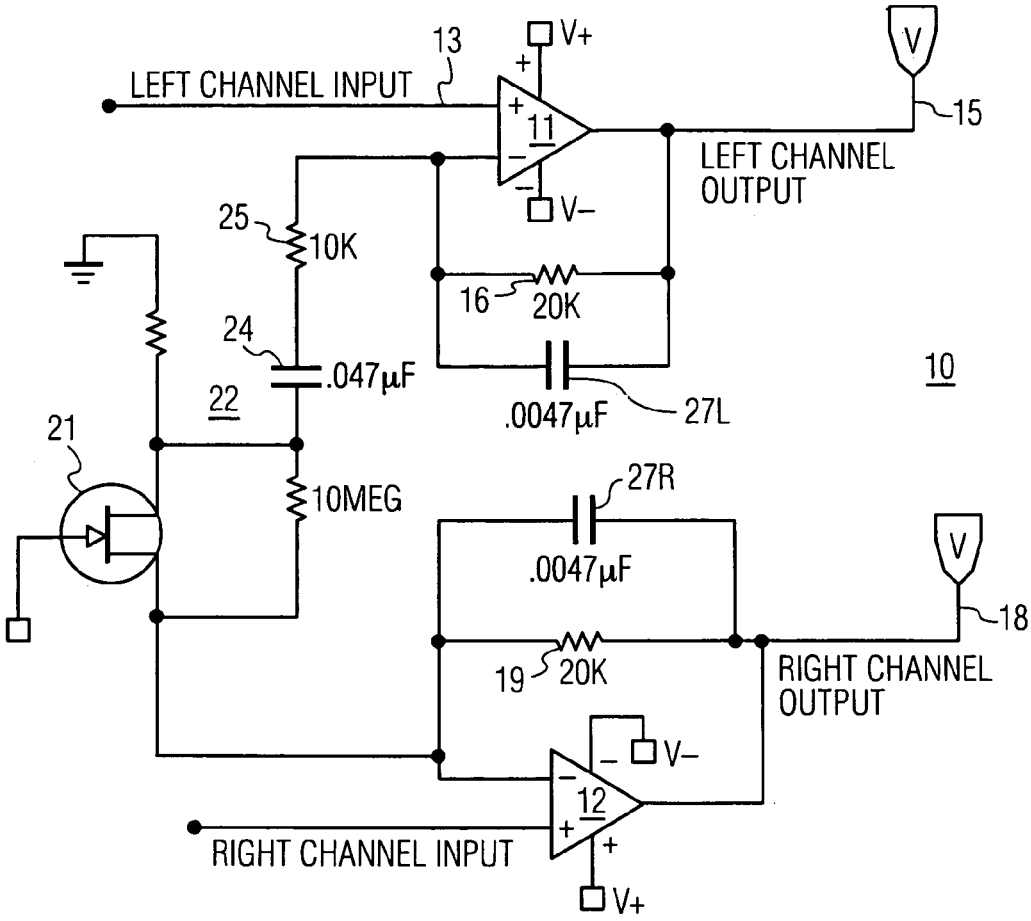
FIG. 1 (PRIOR ART)
FIG. 1 is a schematic diagram showing a prior art stereo expansion circuit which has been already discussed hereinabove.
Figure 2:
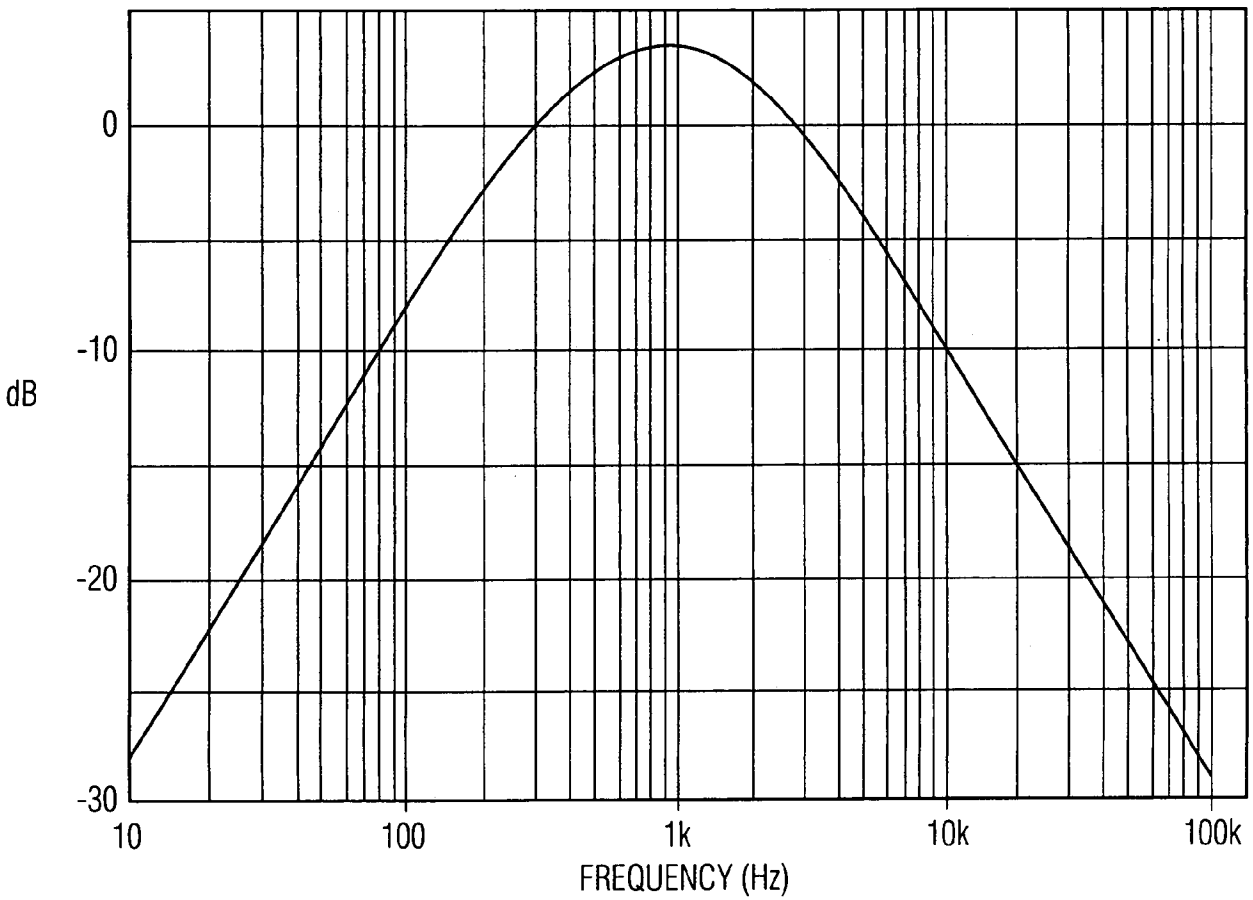
FIG. 2 (PRIOR ART)
FIG. 2 is a graph of frequency vs. amplitude of the circuit of FIG. 1 and has been already discussed hereinabove.

As opposed to the prior art of FIG. 1 wherein the sum and difference signals are irretrievably mixed together in providing the stereophonic expansion, the active matrix type circuit of the present invention has the advantage of isolating the sum signal from the difference signal while still providing stereophonic spatial expansion. This makes it easy to make the amplitude and frequency response changes in both sum and difference signals to optimize the spatial expansion response, e.g., change relative tonal compensations and gains. The active matrixing amplifiers can be considered to be arranged in seriatum, which means that the output of one matrixing amplifier is coupled to the input of another matrixing amplifier.

What is claimed is:

1. A stereophonic expansion circuit comprising:

a first amplifier having an output, a first input for receiving a left and right audio sum signal, and a second input, wherein a first impedance network couples the output to the second input of the first amplifier;

a second impedance network having a first terminal coupled to the second input of the first amplifier and a second terminal to a first switch, wherein when the first switch is in a close position, the second impedance network is coupled to ground, reducing a gain of the first amplifier according to a frequency response of the first and second impedance networks;

an input for receiving a left and right audio difference signal; and a matrixing circuit for producing left and right audio signals from a signal at the output of the first amplifier and the received left and right audio difference signal.

2. The circuit of claim 1, wherein when the first switch is in an open position, the first amplifier functions as a unity gain amplifier.

3. The circuit of claim 1, further comprising a third impedance network coupling the first input of the first amplifier to the first switch, wherein when the first switch is in a close position, the third impedance network is coupled to ground, reducing a magnitude of the left and right audio sum signal to the first amplifier according to a frequency response of the third impedance network.

4. The circuit of claim 1, further comprising a second switch coupling a first terminal of a fourth impedance network and the output of the first amplifier when the second switch is in a close position, and a second terminal of the fourth impedance network is coupled to the second input of the first amplifier.

5. The circuit of claim 1, further comprising a second amplifier disposed between the matrixing circuit and the input for receiving the left and right audio difference signal, the second amplifier having first and second inputs and an output, wherein the left and right audio difference signal is coupled to the first input of the second amplifier and a fifth impedance network couples the output of the second amplifier to the second input of the second amplifier.

6. The circuit of claim 5, further comprising a sixth impedance network having a first terminal coupled to the second input of the second amplifier and a second terminal to a third switch, wherein when the third switch is in a close position, the sixth impedance network is coupled to ground, reducing a gain of the second amplifier according to a frequency response of the fifth and six impedance networks.

7. The circuit of claim 6, wherein when the third switch is in an open position, the second amplifier functions as a unity gain amplifier.

8. The circuit of claim 6, wherein the frequency response of the first and second impedance networks is different from the frequency responses of the fifth and sixth impedance networks.

9. The circuit of claim 6, further comprising a seventh impedance network coupling the first input of the second amplifier to the third switch, wherein when the third switch is in a close position, the seventh impedance network is coupled to ground, reducing a magnitude of the left and right audio difference signal to the second amplifier according to a frequency response of the seventh impedance network.

10. The circuit of claim 6, further comprising a fourth switch couples a first terminal of an eighth impedance network and the output of the second amplifier when the fourth switch is in a close position, and the second terminal of the eighth impedance network is coupled to the second input of the second amplifier.

* * * * *